US011772003B2

(12) United States Patent
Kokhan

(10) Patent No.: US 11,772,003 B2
(45) Date of Patent: Oct. 3, 2023

(54) ELECTRICAL CONSTRUCTION TOY SYSTEM

(71) Applicant: Alexander Kokhan, Tarzana, CA (US)

(72) Inventor: Alexander Kokhan, Tarzana, CA (US)

( * ) Notice: Subject to any disclaimer, the term of this patent is extended or adjusted under 35 U.S.C. 154(b) by 1095 days.

(21) Appl. No.: 15/411,603

(22) Filed: Jan. 20, 2017

(65) Prior Publication Data

US 2017/0128853 A1 May 11, 2017

Related U.S. Application Data

(63) Continuation-in-part of application No. 14/636,027, filed on Mar. 2, 2015, now abandoned.

(60) Provisional application No. 61/946,323, filed on Feb. 28, 2014.

(51) Int. Cl.
*A63H 33/04* (2006.01)
*A63H 5/00* (2006.01)

(52) U.S. Cl.
CPC ..... *A63H 33/042* (2013.01); *A63H 5/00* (2013.01); *A63H 33/046* (2013.01)

(58) Field of Classification Search
CPC .... A63H 33/04; A63H 33/042; A63H 33/086; A63H 33/046; A63H 5/00; A63F 9/10; A63F 9/12; A63F 3/00097; A63F 3/00; A63F 3/00643
USPC ..... 446/90, 91, 92, 93, 117, 118
See application file for complete search history.

(56) References Cited

U.S. PATENT DOCUMENTS 3,237,341 A * 3/1966 Janning ..... F21S 9/02 446/91
3,696,548 A * 10/1972 Teller ..... A63H 33/042 446/91
4,556,393 A * 12/1985 Bolli ..... A63H 33/042 446/91
4,874,176 A * 10/1989 Auerbach ..... A63F 9/1288 273/157 R
4,883,440 A * 11/1989 Bolli ..... A63H 33/042 446/91
5,048,840 A * 9/1991 Johnson, Jr. ..... A63F 3/00214 273/241
5,445,552 A * 8/1995 Hine ..... A63H 33/042 362/249.01
5,779,515 A * 7/1998 Chung ..... A63H 33/04 446/102
5,848,503 A * 12/1998 Toft ..... A63H 33/042 52/173.1
5,871,212 A * 2/1999 Lee ..... A63F 3/02 273/260

(Continued)

*Primary Examiner* — Joseph B Baldori
(74) *Attorney, Agent, or Firm* — Chen-Chi Lin

(57) ABSTRACT

An electrical construction toy system is comprised of one or more base pieces and building blocks. At least one of the base pieces or building blocks providing a power source within the base piece or building block. The connection between base pieces and building blocks does not have to be mechanical, but can be magnetic as well. The connection between base pieces and building blocks further provides an electrical connection from which the power source may pass energy to one or more additional building blocks in varying directions. The connections conduct electricity and some building blocks or base pieces also provide powered effects, such as lighting, sound, and motion effects. In addition, there are several switch blocks to operate the lighting, sound, and motion by a wireless remote control.

4 Claims, 4 Drawing Sheets

(56) References Cited

U.S. PATENT DOCUMENTS 5,876,262 A * 3/1999 Kelly ..... A63H 33/22 108/23
6,062,937 A * 5/2000 Kikuchi ..... A63H 33/042 446/484
6,443,796 B1 * 9/2002 Shackelford ..... A63H 33/042 273/237
6,679,751 B1 * 1/2004 Maxwell ..... A63H 33/00 446/124
7,322,873 B2 * 1/2008 Rosen ..... A63H 33/042 446/124
7,708,615 B2 5/2010 Munch
7,846,002 B1 * 12/2010 Mikesell ..... A63H 33/042 446/91
8,079,890 B2 12/2011 Seligman
8,221,182 B2 * 7/2012 Seymour ..... A63H 33/04 446/120
8,371,894 B1 * 2/2013 Rosen ..... A63H 33/086 446/102
8,529,311 B2 * 9/2013 Tremblay ..... A63H 33/046 446/91
8,690,631 B2 * 4/2014 Nag ..... A63H 33/042 446/125
8,864,546 B1 * 10/2014 Capriola ..... A63H 33/042 331/3
9,144,749 B2 * 9/2015 Munch ..... A63H 33/042
9,393,501 B2 * 7/2016 Sze ..... A63H 33/062
9,472,112 B2 * 10/2016 Schweikardt ..... A63H 33/04
9,782,686 B2 * 10/2017 Hellenga ..... A63H 33/042
2001/0035606 A1 * 11/2001 Schoen ..... A63F 9/12 273/153 R
2002/0196250 A1 * 12/2002 Anderson ..... G06T 19/00 345/420
2003/0148700 A1 * 8/2003 Arlinsky ..... A63H 33/04 446/91
2006/0033272 A1 * 2/2006 Chen ..... A63F 9/12 273/156
2006/0252340 A1 * 11/2006 Bach ..... G09B 23/10 446/124
2007/0184722 A1 8/2007 Doherty
2007/0281580 A1 * 12/2007 Sambenedetto ..... A63H 33/08 446/124
2008/0083149 A1 * 4/2008 Zebersky ..... A63F 9/1044 40/716
2008/0153559 A1 * 6/2008 de Weerd ..... A63F 3/04 463/9
2008/0166926 A1 * 7/2008 Seymour ..... A63H 33/042 439/701
2010/0264589 A1 * 10/2010 Baum ..... A63F 9/0073 273/276
2010/0330867 A1 * 12/2010 Fogel ..... A63H 33/062 446/124
2011/0031689 A1 * 2/2011 Binder ..... A63F 9/1011 273/157 R
2011/0263177 A1 * 10/2011 Lemchen ..... A63H 33/04 446/87
2011/0317391 A1 * 12/2011 Peng ..... A63H 33/042 361/809
2013/0050958 A1 2/2013 Bdeir
2013/0217294 A1 * 8/2013 Karunaratne ..... A63H 33/042 446/90
2013/0217295 A1 * 8/2013 Karunaratne ..... A63H 33/086 446/124
2014/0127965 A1 * 5/2014 Adam ..... A63H 33/042 446/91
2014/0183820 A1 * 7/2014 Tuccillo ..... A63F 9/10 273/156
2015/0104992 A1 * 4/2015 Jung ..... A63H 33/102 446/91
2015/0246293 A1 * 9/2015 Kokhan ..... A63H 33/042 446/91
2015/0360137 A1 * 12/2015 Kay ..... A63H 33/14 446/127
2016/0051904 A1 * 2/2016 Abir ..... A63H 33/042 446/484
2016/0101370 A1 * 4/2016 Madsen ..... A63F 3/04 446/91
2016/0220919 A1 * 8/2016 Almog ..... A63H 33/086
2016/0310862 A1 * 10/2016 Shi ..... A63H 33/042
2016/0325200 A1 * 11/2016 Lu ..... A63H 33/042
2016/0339351 A1 * 11/2016 Akishbekov ..... A63H 33/042
2016/0361662 A1 * 12/2016 Karunaratne ..... A63H 33/042
2017/0036132 A1 * 2/2017 Yang ..... A63H 33/086
2017/0128853 A1 * 5/2017 Kokhan ..... A63H 33/042
2017/0144083 A1 * 5/2017 Rsgaard ..... A63H 33/042

* cited by examiner

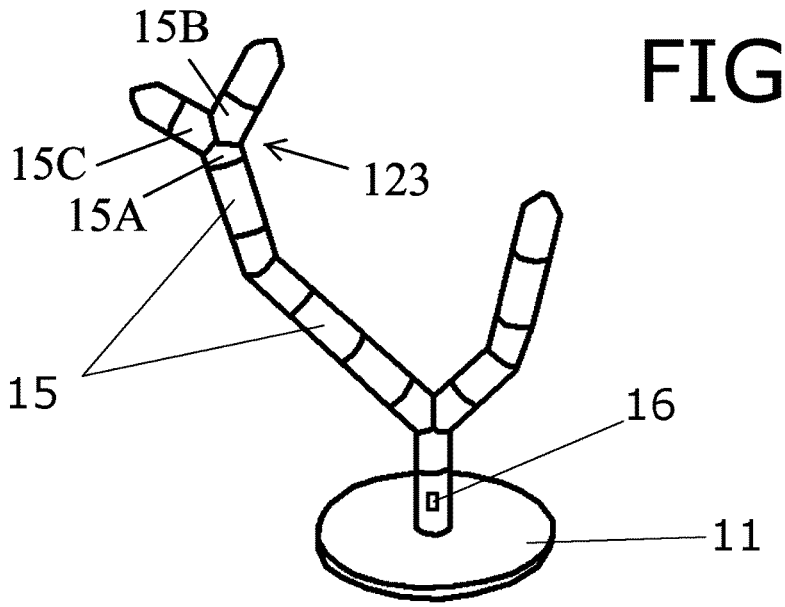
FIG. 7
FIG. 8
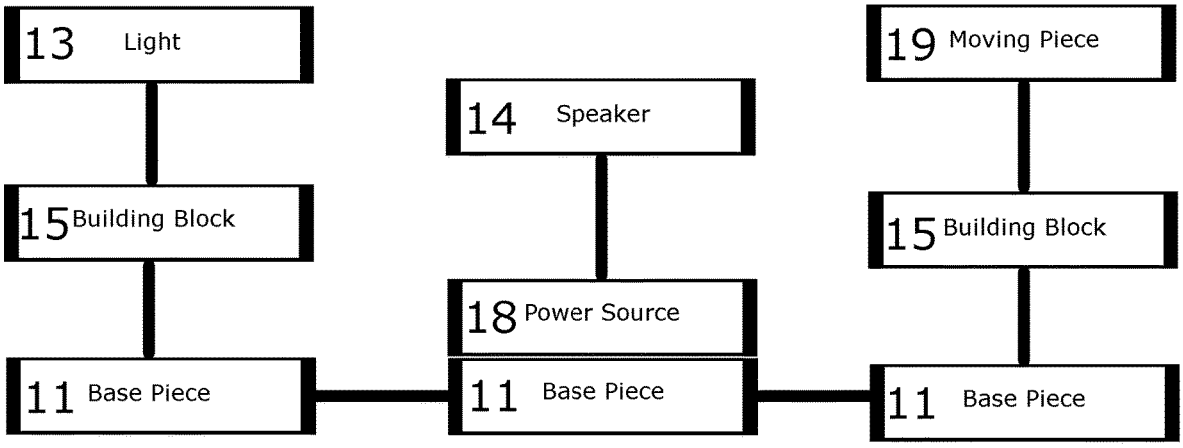

ELECTRICAL CONSTRUCTION TOY SYSTEM

CROSS-REFERENCE TO RELATED APPLICATIONS

This Application claims the benefit of U.S. patent application Ser. No. 14/636,027 filed Mar. 2, 2015 which claimed the benefit of U.S. Provisional Application No. 61/946,323, filed Feb. 28, 2014, which are hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to children's toys and games, and in particular to an electrical construction toy system. The enduring popularity of construction toys, such as Legos™ and Lincoln Logs™, attests to the fact that children like to put things together. Other types of toys and games offer a wide variety of electrically powered features such as lights, sounds, and motion. Parents would welcome a new type of toy which combines construction activities with these electrically powered features. An electrical construction toy system, which provides an assortment of colored building blocks with electrically powered features, would resolve these problems.

SUMMARY OF THE INVENTION

Accordingly, the invention is directed to an electrical construction toy system. One embodiment comprises a flat base having a large surface area and a detachable central power block, which includes a battery or DC transformer from which electrical power is provided to building blocks which modularly connect to the power block and each other. The building blocks provide electrical connections from the power block to one or more additional building blocks in varying directions. The connection between blocks does not have to only be electrical, but can be magnetic as well. This will provide the easiest connection, especially in the second exemplary embodiment. The connections conduct electricity and some building blocks also provide powered effects, such as lighting, sound, and motion effects. In addition, there are several switch blocks to operate the lighting, sound, and motion by a wireless remote control.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate four embodiments of the invention and, together with the description, serve to explain the principles of the invention.

FIG. 7 is a perspective view of the fourth exemplary embodiment assembled, comprising a base piece 11, building blocks 15, a switch 16.

FIG. 8 is a system diagram showing the base piece 11 having a power source 18, means of connecting 12, building blocks 15, lights 13, speakers 14, and moving pieces 19.

DETAILED DESCRIPTION OF THE INVENTION

Figure 1:
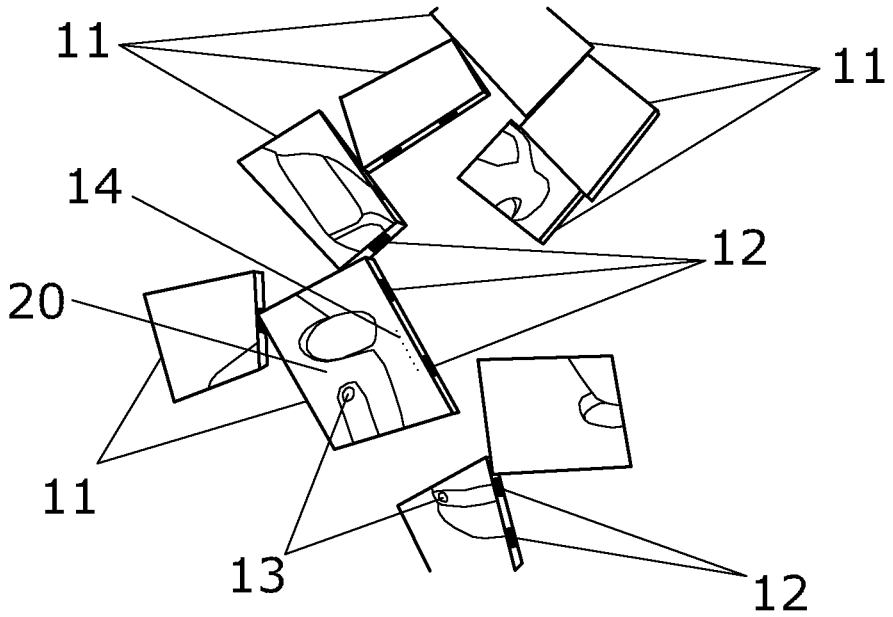
FIG. 1 is a top view of the first exemplary embodiment disassembled, comprising a plurality of building block base pieces 11, means of connecting 12 the building blocks, lights 13, and speakers 14.
Figure 2:
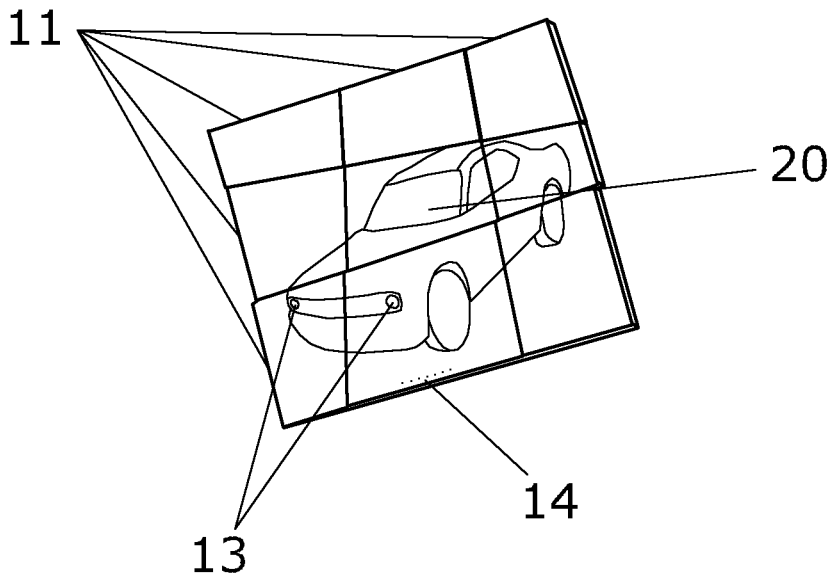
FIG. 2 is a top view of the first exemplary embodiment assembled, comprising a plurality of building blocks 11, lights 13, and speakers 14.
Figure 3:
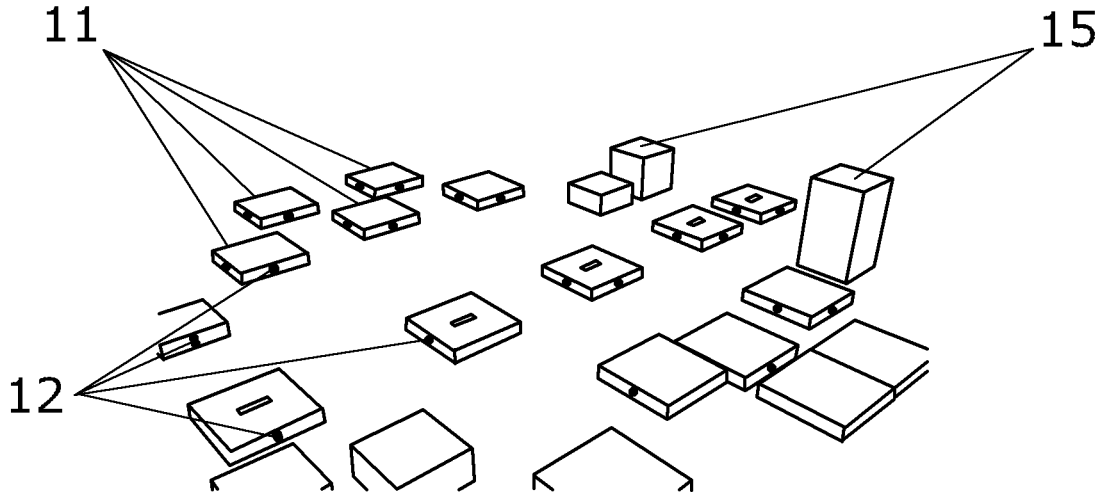
FIG. 3 is a perspective view of the second exemplary embodiment disassembled, comprising a plurality of building block base pieces 11, means of connecting 12 the building blocks, and building blocks 15.
Figure 4:
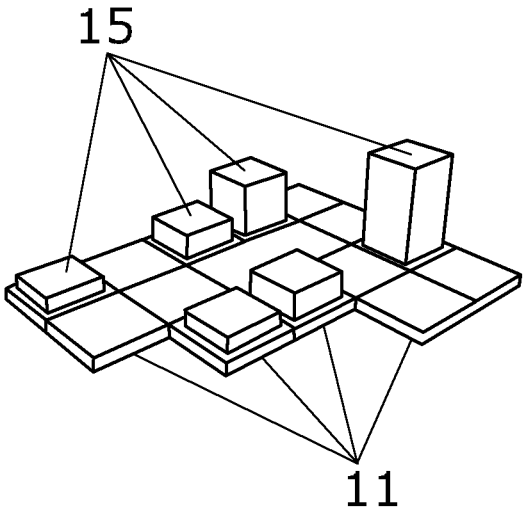
FIG. 4 is a perspective view of the second exemplary embodiment assembled, comprising a plurality of building block base pieces 11, means of connecting 12 the building blocks, and building blocks 15.
Figure 5:
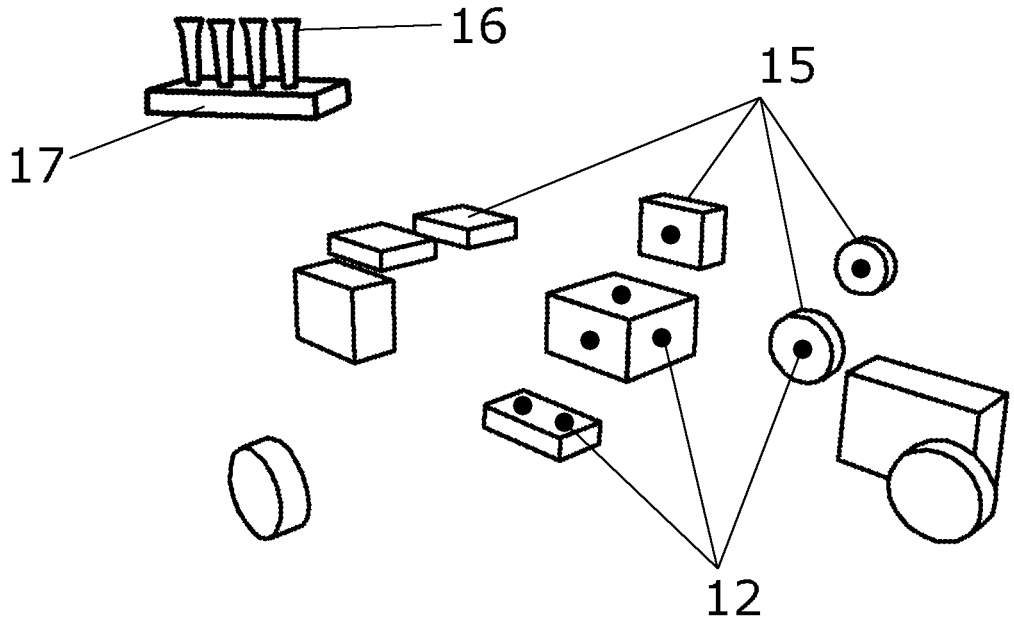
FIG. 5 is a perspective view of the third exemplary embodiment disassembled, comprising a plurality of building blocks 15, and a remote 17.
Figure 6:
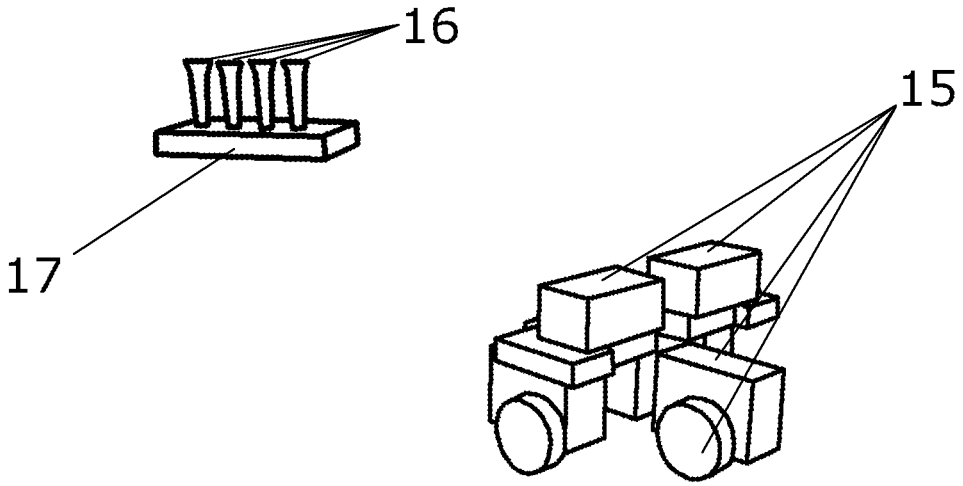
FIG. 6 is a perspective view of the third exemplary embodiment assembled, comprising a plurality of building blocks 15, and a remote 17.

Referring now to the invention in more detail, the invention is directed to an electrical construction toy system. The system comprises a flat base 10 being made of one or more building block base pieces 11. The flat base 10 has a large surface area and a power source 18. The system also provides building blocks 15. The power source 18 may include a battery or DC transformer from which electrical power is provided. Each base piece 11 provides means of connecting 12 to other base pieces 11 or building blocks 15. The means of connecting 12 maybe magnets, clips, or pegs (11 or 15). The means of connecting 12 further provides electrical connections between the base pieces 11 and/or building blocks 15 such that power passes between the base pieces 11 and/or building blocks 15 from the power source 18. Some base pieces 11 and building blocks 15 also provide powered effects, such as lights 13, sound from speakers 14, and motion effects in moving pieces 19. In addition, the system may provide switches 16 or remotes 17 to operate the lights 13, speakers 14, and moving pieces 19.

The various embodiments of the invention are intended to employ the features of the invention in construction play sets with differing appearances. Each of the embodiments is intended for distribution to children of differing age groups, and the age groups of distribution of the various embodiments may overlap or coincide. The building blocks 15 which provide lights 13 are preferably translucent, with light-emitting diodes (LEDs) mounted internally. The other building blocks 15 and the base pieces 11 are preferably opaque. All of the building blocks 15 and the base pieces 11 are preferably manufactured in bright colors, such as red, yellow, green, and blue.

The first exemplary embodiment provides a construction play set which provides a simple flat or two-dimensional appearance when assembled. The base pieces 11 are preferably square or rectangular, but may be provided in various shapes. The base pieces 11 may provide a specific image 20 or pattern on the top surface such that when all the base pieces 11 are assembled the image 20 is completed, similar to how a puzzle functions. When all the base pieces 11 are assembled in the appropriate way such that the image 20 is completed the means of connecting 12 between the base pieces 11 supply power to each other from the power source 18 by completing a circuit through the base pieces 11. The completed circuit activates any lights 13, speakers 14, or moving pieces 19 which are part of the base pieces 11.

The second exemplary embodiment is similar to the first exemplary embodiment except that it further provides the appearance of a three-dimensional town, university campus, or other group of buildings when assembled. The flat base 10 is formed by connecting a plurality of base pieces 11. The power source 18 is preferably provided within one of the plurality of base pieces 11. The system further provides one or more building blocks 15 which are preferably shaped like buildings. In the second exemplary embodiment, the base pieces provide means of connecting 12 on their side surfaces such that the base pieces 11 connect to form the flat base 10 and complete the circuit from the power source 18. One or more base pieces 11 further provide means of connecting 12 on their top surfaces such that one or more building blocks 15 can be placed on top of the base pieces 11. These connections provide power from the power source 18 to the base pieces 11 and building blocks 15. As in the first exemplary embodiment, the base pieces 11 and building blocks 15 may provide lights 13, speakers 14, or moving parts 19 such that when the base pieces 11 or building blocks 15 are connected to the power source (directly or indirectly) the lights 13, speakers 14, and moving parts 19 are activated.

The third exemplary embodiment is similar to the first two exemplary embodiments except that it does not provide base pieces 11. Rather, the third exemplary embodiment proves only building blocks 15 which may come in any shape or size. The building blocks provide means of connecting 12 such that the building blocks may be attached to each other to form different shapes such as a vehicle, building, animal, or any other shape. At least one building block 15 provides a power source 18 which provides power to all the building blocks 15 connected via the means of connecting 12. As in the previous two embodiments, the building blocks may provide lights 13, speakers 14, or moving parts 19 such that the lights 13, speakers 14, and moving parts 19 are activated when power is supplied to them. The third exemplary embodiment further provides a remote 17 which provides one or more switches 16. The switches 16 are configured to wirelessly activate power sources 18 within the building blocks 15. The remote 17 may provide more than one switch 16 which each activate a different power source 18. One power source 18 may provide power to lights 13, while another power source 18 may provide power to moving parts 19.

The fourth exemplary embodiment provides a construction play set which provides the appearance of a tree when assembled. The base 10 is preferably circular or elliptical and made of one or more base pieces 11 providing a power source 18. The building blocks 15 are preferably cylindrical or conical in shape. The building blocks 15 may connect to the flat base 10 and to each other using the previously discussed means of connecting 12. These connections form a circuit through which power may pass. As in the previous embodiments, the building blocks 15 may provide lights 13, speakers 14, or moving parts 19 which are activated when power is supplied. In FIG. 7, a first building block of conical shape 15A, a second building block of conical shape 15B and a third building block of conical shape 15C are directly connected at a branching location 123 of the tree.

To use the first, second, third, and fourth exemplary embodiments, the user connects the base pieces 11 and building blocks 15 via the connecting means 12. The power source 18 (located within one or more of the base pieces 11 or building blocks 15) then provides power to the other base pieces 11 and building blocks 15 as the power passes through the connecting means 12 between each base piece 11 and building block 15. Any lights 13, speakers 14, and moving parts 19 which are a part of any of the base pieces 11 or building blocks 15 are then activated by the power.

The base pieces 11 and the building blocks 15 are preferably manufactured from rigid, durable materials which are easily cleaned, such as wood, plastic, or acrylic polymer. Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. An electrical construction toy system, comprising:

one or more base pieces;

a power source embedded within at least one of said one or more base pieces;

one or more building blocks; and one or more powered effects;

wherein the electrical construction toy system is characterized by:

a disassembled condition in which the one or more base pieces are separated from one another; and the one or more building blocks are separated from one another; and an assembled condition in which the one or more base pieces are connected in a pre-determined order so that a flat base is formed;

the one or more building blocks are connected;

a subset of the one or more building blocks are connected to a top surface of the flat base; and an electrical connection is provided so that power from the power source activates the one or more powered effects;

wherein said one or more building blocks are of cylindrical or conical shapes such that when connected the electrical construction toy system is of a shape of a tree with a plurality of branches.

2. The electrical construction toy system of claim 1, wherein said one or more powered effects are lights, speakers, or moving parts.

3. The electrical construction toy system of claim 1, wherein the one or more base pieces are made of wood and wherein the one or more building blocks are made of wood.

4. An electrical construction toy system, comprising:

one or more base pieces;

a power source embedded within at least one of said one or more base pieces;

one or more building blocks; and one or more powered effects;

wherein the electrical construction toy system is characterized by:

a disassembled condition in which the one or more base pieces are separated from one another; and the one or more building blocks are separated from one another; and an assembled condition in which the one or more base pieces are connected in a pre-determined order so that a flat base is formed;

the one or more building blocks are connected;

a subset of the one or more building blocks are connected to a top surface of the flat base; and an electrical connection is provided so that power from the power source activates the one or more powered effects;

wherein said one or more building blocks are of cylindrical or conical shapes such that when connected the electrical construction toy system is of a shape of a tree with a plurality of branches; wherein a first building block of conical shape, a second building block of conical shape and a third building block of conical shape are directly connected at a branching location of the tree.

* * * * *